US009423122B2

(12) United States Patent
Kauppinen et al.

(10) Patent No.: US 9,423,122 B2
(45) Date of Patent: Aug. 23, 2016

(54) CIRCULATING FLUIDIZED BED BOILER HAVING TWO EXTERNAL HEAT EXCHANGERS FOR HOT SOLIDS FLOW

(75) Inventors: Kari Kauppinen, Varkaus (FI); Pertti Kinnunen, Varkaus (FI)

(73) Assignee: AMEC FOSTER WHEELER ENERGIA OY, Espoo (FI)

( * ) Notice: Subject to any disclaimer, the term of this patent is extended or adjusted under 35 U.S.C. 154(b) by 144 days.

(21) Appl. No.: 13/976,065

(22) PCT Filed: Feb. 22, 2012

(86) PCT No.: PCT/FI2012/050172
§ 371 (c)(1),
(2), (4) Date: Jul. 8, 2013

(87) PCT Pub. No.: WO2012/113985
PCT Pub. Date: Aug. 30, 2012

(65) Prior Publication Data

US 2013/0284120 A1 Oct. 31, 2013

(30) Foreign Application Priority Data

Feb. 24, 2011 (FI) ..... 20115181

(51) Int. Cl.
*F23G 5/30* (2006.01)
*F22B 31/00* (2006.01)
(Continued)

(52) U.S. Cl.
CPC ..... *F22B 31/003* (2013.01); *F22B 31/0092* (2013.01); *F22D 1/02* (2013.01); *F23C 10/04* (2013.01); *F23C 10/26* (2013.01); *F23C 10/32* (2013.01); *F23C 10/10* (2013.01)

(58) Field of Classification Search
CPC ..... F22B 31/0092; F23C 10/04; F22D 1/02
USPC ..... 122/4 D, 421; 165/104.18; 431/170
See application file for complete search history.

(56) References Cited

U.S. PATENT DOCUMENTS 5,463,968 A * 11/1995 Abdulally ..... 110/347
6,631,698 B1 * 10/2003 Hyppanen et al. ..... 122/4 D
(Continued)

FOREIGN PATENT DOCUMENTS

JP H09-243019 A 9/1997
JP 2009-536312 A 10/2009
(Continued)

OTHER PUBLICATIONS

Japanese Office Action dated Aug. 26, 2014, issued in counterpart Japanese Patent Application No. 2013-552998, with an English translation.
(Continued)

*Primary Examiner* — Alissa Tompkins
*Assistant Examiner* — John Bargero
(74) *Attorney, Agent, or Firm* — Fitzpatrick, Cella, Harper & Scinto

(57) ABSTRACT

A circulating fluidized bed boiler includes a furnace for combusting solid carbonaceous fuel in a fast fluidized bed. A solids separator is adjacent to a sidewall of the furnace and separates solids entrained with exhaust gas discharged via an outlet channel. A gas seal conveys at least a portion of the separated solids to a first fluidized bed heat exchange chamber that is arranged downstream of the gas seal and has internal heat exchange surfaces. A first lift channel has a lower end connected to a bottom portion of the first fluidized bed heat exchange chamber and an upper end connected to an upper end of a first return channel for discharging solids from the first fluidized bed heat exchange chamber and taking the cooled solids to a lower portion of the furnace. A second fluidized bed heat exchange chamber is arranged adjacent to a lower sidewall of the furnace.

6 Claims, 3 Drawing Sheets

(51) Int. Cl.

| | |
|---|---|
| ***F23C 10/04*** | (2006.01) |
| ***F23C 10/26*** | (2006.01) |
| ***F23C 10/32*** | (2006.01) |
| ***F22D 1/02*** | (2006.01) |
| *F23C 10/10* | (2006.01) |

(56) References Cited

U.S. PATENT DOCUMENTS

| | | | |
|---|---|---|---|
| 8,807,053 | B2 | 8/2014 | Kauppinen |
| 2009/0293818 | A1 | 12/2009 | Kauppinen |
| 2011/0220038 | A1 | 9/2011 | Kauppinen et al. |

FOREIGN PATENT DOCUMENTS

| | | | |
|---|---|---|---|
| WO | 2007/128883 | A2 | 11/2007 |
| WO | 2010/052372 | A1 | 5/2010 |

OTHER PUBLICATIONS

Finnish Office Action dated Jan. 31, 2012, issued in corresponding Finnish Patent Application No. 20115181.

Notification of and International Search Report completed Jul. 4, 2012, and mailed on Jul. 13, 2012, in corresponding International Patent Application No. PCT/US2012/050172.

Written Opinion mailed on Jul. 13, 2012, in corresponding International Patent Application No. PCT/US2012/050172.

* cited by examiner

CIRCULATING FLUIDIZED BED BOILER HAVING TWO EXTERNAL HEAT EXCHANGERS FOR HOT SOLIDS FLOW

CLAIM OF PRIORITY

Our invention relates to a circulating fluidized bed boiler. In more detail, the circulating fluidized bed boiler of the present invention is preferably a once through utility (OTU) boiler, for example, for power generation or industrial steam production. As the size of boilers increases, the relation of the wall surface area to the volume of the furnace usually becomes disadvantageous, which may cause problems, for example, in positioning of the different devices and conduits related to the furnace, as well as feed the feeding and mixing of different materials. The present invention especially relates to solving problems related to large circulating fluidized bed (CFB) boilers.

FIELD OF THE INVENTION

Our invention relates to a circulating fluidized bed boiler. In more detail, the circulating fluidized bed boiler of the present invention is preferably a once through utility (OTU) boiler, for example, for power generation or industrial steam production. As the size of boilers increases, the relation of the wall surface area to the volume of the furnace usually becomes disadvantageous, which may cause problems, for example, in positioning of the different devices and conduits related to the furnace, as well as feed and mixing of different materials. The present invention especially relates to solving problems related to large circulating fluidized bed (CFB) boilers.

BACKGROUND OF THE INVENTION

Generally speaking, a circulating fluidized bed boiler comprises a furnace for combusting fuel, an outlet channel connected to the upper section of the furnace for the discharge of flue gas out of the furnace, a solids separator for receiving the flue gas via the outlet channel from the furnace, and for separating solid particles from the flue gas. The CFB boiler further comprises at the lower portion of the solids separator, a return channel for taking the hot solids separated by means of the solids separator to the lower section of the furnace, and at the upper portion of the solids separator, a flue gas duet for removing cleaned flue gas to the backpass of the boiler, to gas cleaning devices and, further, through the stack to the environment.

The outlet channel, solids separator, and the return channel form a so-called external hot circulation, in which the hot solids entrained in the flue gas are first taken out of the furnace, then treated in the separator, and finally, returned to the furnace. Most often, somewhere in the external circulation, in flow communication with the solids return channel, a fluidized bed heat exchanger is arranged. The heat exchanger may be supported to the lower portion of the solids separator such that the return channel takes the solids from the heat exchanger to the lower section of the furnace. Or, the heat exchanger may be supported by a side wall of the furnace, such that the return channel takes the solids from the solids separator to the heat exchange chamber. As to the fluidized bed heat exchangers, they may also be arranged in the internal circulation, i.e., for receiving the solids from the bed material flowing down along the furnace walls. And, naturally, there are also fluidized bed heat exchangers that may receive solids from either the internal or the external circulation, or simultaneously, from both circulations.

The lower section of the furnace is provided with feeds for feeding fuel, inert bed material, and possibly sulfur binder to the furnace, and, finally, the bottom of the furnace is provided with feeds for feeding oxide-containing fluidizing gas into the furnace, in other words, a gas inlet channel, a wind box, and nozzles.

Published PCT International Application No. WO 2007/128383 A2 discusses a fluidized bed heat exchanger structure for a CFB boiler. The CFB boiler of the PCT publication, or in fact, the fluidized bed heat exchanger, comprises two heat exchange chambers arranged in series in communication with the return channel, such that a first fluidized bed heat exchange chamber supported below the solids separator receives hot solids directly, actually, via a gas seal, from the solids separator, and then, in normal conditions, discharges the cooled solids to a second fluidized bed heat exchange chamber arranged in connection with the wall of the lower section of the furnace. Finally, the cooled solids are returned to the furnace from the second heat exchange chamber.

In accordance with the teachings of the PCT publication, the upper heat exchange chamber is also provided with a return for returning cooled solids from the upper heat exchange chamber directly to the furnace. Both heat exchange chambers have internal heat exchange surfaces arranged within the heat exchange chambers for cooling the solids before they are returned to the lower section of the furnace. In other words, the two heat exchange chambers discussed above are connected in series in the external solids circulation of a CFB boiler.

It is a specific feature of the second, i.e., the lower heat exchange chamber, of the above-mentioned PCT publication that the heat exchange chambers may receive hot solids, not only from the first heat exchange chamber, but also, from the internal circulation, i.e., the second heat exchange chamber is provided with an inlet arranged in the wall of the lower section of the furnace such that hot solids flowing down along the boiler walls are able to enter the second fluidized bed heat exchange chamber. Further, the heat exchanger arrangement of the PCT publication is provided with an overflow for allowing overflow of solids from the first heat exchange chamber directly to the second heat exchange chamber, in a case that the solids flowing into the first heat exchange chamber is larger than the discharge flowing out of the first heat exchange chamber. In connection with this discussion concerning the heat exchangers, it should be understood that a large CFB boiler is usually provided with several parallel solids separators and heat exchangers connected to their return channel either on one side of the boiler or on both sides thereof, but, for clarity reasons, both above and in the following description of the invention, mainly, only one heat exchange arrangement with one solids separator, is discussed.

The starting point in the development of the fluidized bed heat exchanger of the PCT publication discussed above was to be able to construct a heat exchange arrangement that may be used in almost all possible applications due to its versatile controlling possibilities. A problem the construction of the PCT publication solved related to the traditional location of the fluidized bed heat exchange chambers on the outside walls of the lower section of the furnace. While the CFB boilers grew, it was not possible to increase the size of the fluidized bed heat exchange chambers accordingly, as increasing the height of a heat exchange chamber resulted in the increase of pressure losses in the fluidization air, and an increase in the width of the heat exchanger was not possible due to a lack of space. Thus, the growing size of the CFB boilers was taken into account in the PCT publication by arranging the heat exchangers one on top of the other, whereby requirements relating to both the available space and the acceptable pressure Josses were taken into account. And, finally, the adjustability or controllability of the heat exchange arrangement was ensured by providing the arrangement with equipment giving a possibility to run the arrangement in several different ways.

When all the above-discussed and other considerations were taken into account in the design of the heat exchange arrangement, however, the construction of the arrangement became less optimal for some specific applications. Such applications are cases when no extensive control is required, or cases when the connection of the heat exchange chambers in series is not desired, for some reason. In other words, the prior art arrangement has a few drawbacks or problems.

First, since the upper heat exchange chamber is supposed to discharge the cooled solids to the lower one, the channel between the heat exchange chambers runs between the upper heat exchange chamber and the furnace forcing positioning of the first/upper heat exchange chamber substantially far from the furnace wall. This also means that the solids separator has to be positioned far from the furnace, as the upper heat exchange chamber is normally positioned right below the separator, and supported from the separator.

Second, as the lower heat exchange chamber is supposed to be able to receive all the cooled solids from the upper heat exchange chamber, and possibly, also some additional solids from the internal circulation, it is clear that the volume of the lower heat exchange chamber should at least correspond to the one of the upper heat exchange chamber. As already discussed above in connection with the PCT publication (WO 2007/128883 A2), neither the height nor the width (in a direction parallel to the furnace wall) of the lower heat exchanger can be chosen freely, but both the pressure loss in the fluidization, and the space occupied by the heat exchange chamber have to be considered. The above consideration results in that the dimensions of the lower heat exchange chamber are substantially equal with the upper one. Thereby, there is very little room in connection with the lower section of the furnace for the equipment necessary for running the boiler, such as, for example, the start-up burner, a temperature measuring device for measuring the lower furnace temperature, a pressure measurement device for measuring the bed pressure, and feeds for introducing fuel, bed material, secondary air, additives, recirculated flue gas (if in use), etc.

Third, due to the various running alternatives, i.e., control options in the prior art boiler, there are conduits and channels for each alternative. For instance, the upper heat exchange chamber has one inlet from the separator, and several outlet channels and lift channels. One lift channel and outlet channel leading to the lower heat exchanger, another lift channel and outlet channel leading to the furnace, and overflow channels leading to both the lower heat exchange chamber and to the furnace. In addition to the channels, rather complicated fluidization means and controllers for adjusting the fluidizations are also required at the bottom of the upper heat exchange chamber. If, and when, the various channels and conduits require bellows to separate components in different temperatures, the bellows, again, occupy space, and also increase the costs of the heat exchanger arrangement together with the already numerous channels, conduits, fluidization equipment, and control systems that have been discussed above. And, still further, all of the channels and conduits need to be either made of water/steam tube walls and connected to the rest of the steam/water system, or made of a refractory material. Irrespective of the manufacture, this adds to the expenses as constructing the channels of water/steam tube walls or refractory material is a complicated and time-consuming task.

For the above reasons, it has been found necessary to improve the construction of a CFB boiler and its heat exchanger arrangement.

SUMMARY OF THE INVENTION

An object of the present invention is to provide a circulating fluidized bed boiler, in which problems and drawbacks of the prior art discussed above are minimized.

A further object of the present invention is to provide a simpler heat exchanger arrangement as compared to the prior art.

Yet another, further object of the present invention is to provide a heat exchanger arrangement that offers the boiler designer more alternatives in positioning various components of the boiler system in the lower section of the furnace.

In order to solve the above-mentioned problems of the prior art, our invention provides a circulating fluidized bed boiler (CFB) with a novel heat exchanger arrangement. The CFB boiler comprises a furnace for combusting solid carbonaceous fuel in a fast fluidized bed, the furnace having walls made of water/steam tube panels and used for evaporating the water fed therein, a solids separator arranged adjacent to a sidewall of the furnace for separating solids entrained with exhaust gas discharged via an outlet channel from an upper portion of the furnace, a gas seal for conveying at least a portion of the separated solids to a first fluidized bed heat exchange chamber arranged downstream of the gas seal and having internal heat exchange surfaces, a first lift channel, having a lower end connected to a bottom portion of the first fluidized bed heat exchange chamber and an upper end connected to an upper end of a first return channel for discharging solids from the first fluidized bed heat exchange chamber and taking the cooled solids to a lower portion of the furnace, a second fluidized bed heat exchange chamber arranged adjacent to a lower sidewall of the furnace and having internal heat exchange surfaces, an inlet channel arranged between the second fluidized bed heat exchange chamber and the furnace for introducing hot solids from the furnace to the second heat exchange chamber, a second lift channel having a lower end connected to a bottom portion of the second fluidized bed heat exchange chamber and an upper end connected to discharge the solids to the lower portion of the furnace, the first fluidized bed heat exchange chamber being positioned above the second fluidized bed heat exchange chamber, wherein the first heat exchange chamber has two first lift channels and two first return channels arranged at the lateral sides thereof such that the second heat exchange chamber is situated between the lower ends of the two first return channels.

Other features of the present invention will be discussed in more detail as follows.

The advantages gained by the construction and the design of the CFB boiler of the present invention are as follows;

- a smaller-sized lower heat exchange chamber;
- the lower heat exchange chamber has a lighter construction;
- the lower heat exchange chamber is easier to support from the furnace wall;
- the lower heat exchange chamber leaves room for other equipment;
- there is no return channel from the upper fluidized bed heat exchange chamber to the lower one;
- a simple heat exchanger arrangement construction;

a separator and an upper heat exchange chamber that are closer to the furnace;

a possibility to position equipment necessary for the working of the CFB boiler to the sides of the lower fluidized bed heat exchange chamber;

the ability to provide different temperatures of the solids entering the upper and lower heat exchange chambers;

no need to use bellows in connection with the lower heat exchange chamber;

mixing of fuel in the solids discharged from the upper heat exchange chamber;

mixing of the fuel and the solids discharged from the lower heat exchange chamber in the bed area of the furnace;

separately supported upper and lower heat exchange chambers, the weight of the chambers divided between the solids separator and the wall of the lower section of the furnace; and returning solids from the upper heat exchange chamber at a higher temperature to the lower part of the furnace, as the solids pass only one heat exchange chamber.

BRIEF DESCRIPTION OF THE DRAWINGS

The present invention is described in more detail in the following with reference to the attached drawings, of which

DETAILED DESCRIPTION OF THE PREFERRED EMBODIMENTS

Figure 1:
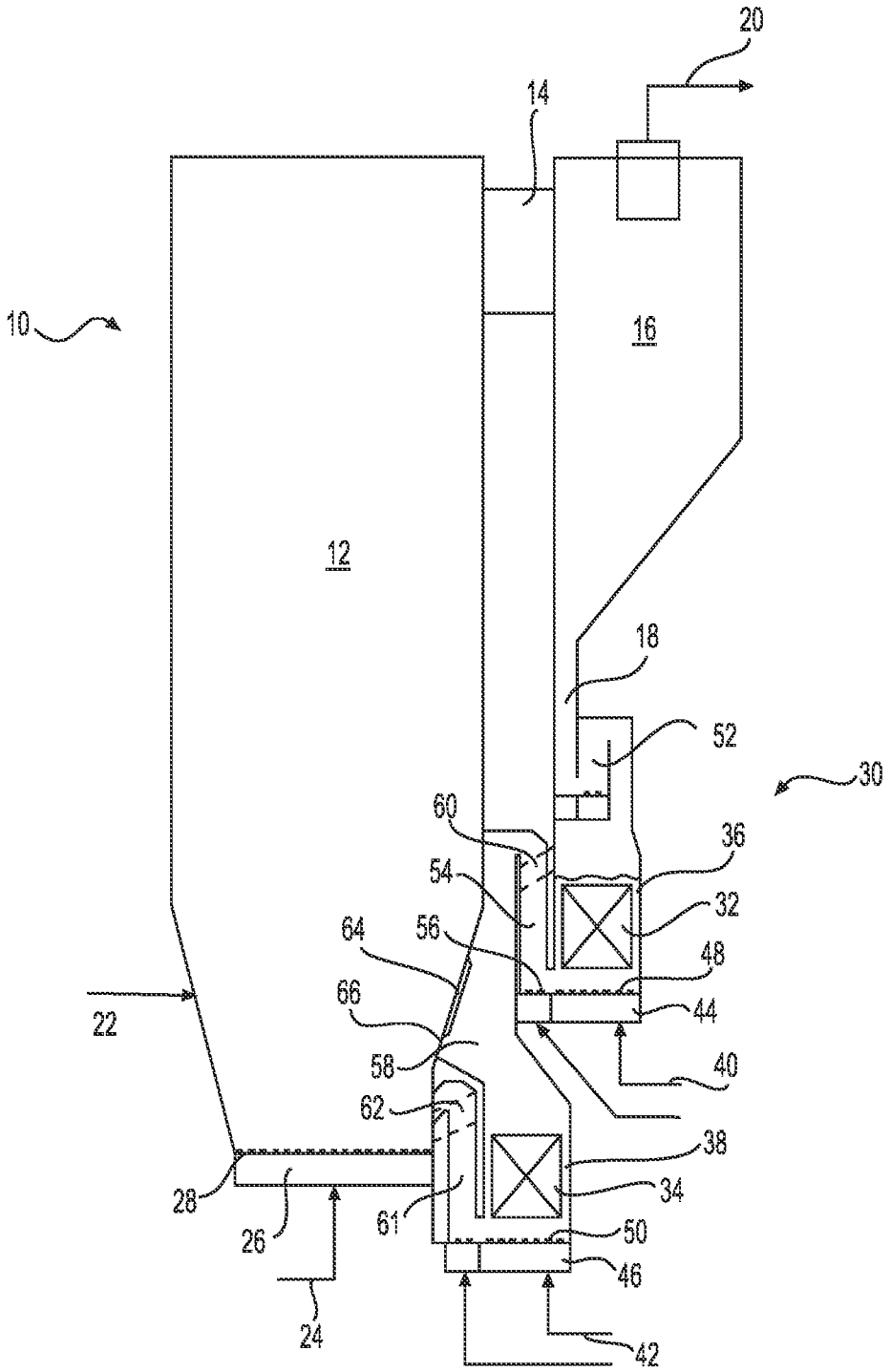
FIG. 1 PRIOR ART
FIG. 1 is a schematic vertical cross section of a circulating fluidized bed boiler provided with a heat exchanger arrangement in accordance with the prior art.

FIG. 1 illustrates a prior art circulating fluidized bed (CFB) boiler 10 comprising a furnace 12 for combusting fuel, an outlet channel 14 connected to the upper section of the furnace 12 for the discharge of flue gas out of the furnace 12, a solids separator 16 for receiving the flue gas via the outlet channel 14 from the furnace 12, and for separating solid particles from the flue gas. The CFB boiler 10 further comprises, at the lower portion of the solids separator 16, a return channel 18 for taking the hot solids separated by the solids separator 16 out of the separator 16 towards the lower section of the furnace 12, and, at the upper portion of the solids separator 16, a flue gas duct 20 for removing cleaned flue gas to the backpass of the boiler 10, gas cleaning devices, and further, through the stack to the environment. The outlet channel 14, the solids separator 16, and the return channel 18 form a so-called external hot circulation, where the hot solids entrained in the fine gas are first taken out of the furnace 12, then treated in the separator 16, and finally, returned to the furnace 12. The lower section of the furnace 12 is provided with a feed 22 for feeding fuel, inert bed material, secondary air, and possibly, sulfur binder to the furnace. Finally, the bottom of the furnace 12 is provided with a feed for feeding oxide-containing fluidizing gas into the furnace 12, in other words, the feed comprises a gas inlet channel 24, a wind box 26, and nozzles 28.

Most often, somewhere in the external circulation, a fluidized bed heat exchanger (36) is arranged. The fluidized bed heat exchanger may be supported to the lower portion of the solids separator 16 such that the return channel 18 takes the solids from the heat exchanger to the lower section of the furnace 12. Or, the fluidized bed heat exchanger may be supported by the side wall of the furnace 12 such that the return channel 18 takes the solids from the solids separator 16 to the heat exchange chamber. The prior art also shows fluidized bed heat exchange chambers arranged outside the furnace wall in the internal circulation, which means that the fluidized bed heat exchange chamber receives solids flowing down along the furnace walls, cools the solids, and returns them back to the furnace.

FIG. 1 illustrates a further developed construction where the fluidized bed heat exchanger between the solids separator 16 comprises two heat exchange chambers, a first or upper heat exchange chamber 36 and a second or lower heat exchange chamber 38 arranged below the first heat exchange chamber 36, each heat exchange chamber being provided with an internal heat exchange surface 32, 34. The bottoms of the first and second heat exchange chambers 36, 38 are provided with a gas inlet duct 40, 42, a wind box 44, 46, and nozzles 48, 50 for fluidizing the bed of solids being formed in the heat exchange chambers 36, 38.

In operation, the heat exchanger of FIG. 1, functions such that the hot solids flowing from separator 16 are passed along the return channel 18 through a gas seal 52 into the upper part of the fluidized bed of particles in the first heat exchange chamber 36. The lower section of the heat exchange chamber is provided with a lifting channel 54, the lower section of the lifting channel having nozzles 56, which make the solids flow at a desired velocity through the heat exchange chamber 36 to be further discharged through the upper part of the lifting channel 54 into an inlet channel 58 of the second heat exchange chamber 38. The upper section of the first heat exchange chamber 36 is preferably arranged with an overflow channel 60 via which excess solids are discharged either to the second heat exchange chamber 38 or back to the furnace 12, if the amount of solids to be discharged through the lifting channel 54 is less than the amount of solids entering the heat exchange chamber 36 through the separator 16. The amount of solids passing through the first heat exchange chamber 36 is preferably adjustable by means of the lifting channel 54 and the overflow channel 60.

In the arrangement of FIG. 1, the lower heat exchange chamber 38 is equal to the upper heat exchange chamber 36, except that, in the lower heat exchange chamber 38, the flow of particles entering the heat exchange chamber is received from the upper part of the lifting channel 54 of the upper, i.e., the first heat exchange chamber 36, and from the overflow channel 60 along the inlet channel 58 into the upper part of the fluidized bed of particles in the lower, i.e., the second heat exchange chamber 38. In the manner of the first heat exchange chamber 36, the second heat exchange chamber 38, too, has a lifting channel 61 for discharging cooled solids from the chamber 38, and an overflow channel 62 in case the amount of solids entering the heat exchange chamber 38 is larger than what the lifting channel 61 is able to discharge. Furthermore, the solids to be discharged from the upper part of the lifting channel 61 of the lower heat exchange chamber 38 and from the overflow channel 62 are passed into the furnace 12.

Further, FIG. 1 also shows how the upper section of the lower heat exchange chamber 38, preferably, the inlet channel 58, comprises inlet opening(s) 64 for passing solids into the heat exchange chamber 38 directly from the internal circulation of the solids in the furnace 12. The inlet openings 64 are preferably arranged in the oblique surfaces 66 in the lower section of the furnace 12, in which case, hot solids flow through openings 64 into the heat exchange chamber 38, also, at small loads of the boiler 10, in which case, the fluidizing velocity of the solids in the furnace 12 is relatively low.

Normally, the walls of the furnace 12, as well as the walls of the solids separator 16, of the fluidized bed heat exchange chambers 36, 38, and also, of some conduits and channels, are made of water tube panels (sometimes called membrane walls) serving as so-called evaporating surfaces or as water heating surfaces, in which water tube panels, the high-pressure feed water of the boiler steam cycle, heated in an economizer (not shown in FIG. 1) arranged in the boiler backpass, is converted to steam, or feed water is further heated. The steam temperature is further, after the evaporating surfaces, raised in superheaters, the last stage of the superheaters normally being arranged in the heat exchanger 30 of the external hot circulation. The superheated steam is passed into a high pressure steam turbine, having a generator connected therewith, for generating electricity. In high-efficiency boilers, the steam leaving the high-pressure turbine at a lower pressure is passed to reheaters, for reheating. Advantageously, the last stage of the reheaters may also be arranged in the heat exchanger 30 of the external hot circulation. The hot steam generated thereby is further passed to a lower-pressure steam turbine, in order to increase the quantity of produced electricity and the total efficiency of the plant.

As has already been explained above, however, the heat exchanger arrangement of FIG. 1 has a number of drawbacks and problems related thereto.

First, since the upper heat exchange chamber 36 is supposed to discharge the cooled solids to the lower one 38, the channel between the heat exchangers runs between the upper heat exchanger 36 and the furnace 12 forcing positioning of the first heat exchanger 36 substantially far from the furnace 12. This also means that the solids separator 16 has to be positioned far from the furnace 12, as the heat exchange chamber 36 is normally positioned right below the solids separator 16, and is supported by the separator 16.

Second, as the lower heat exchange chamber 38 is supposed to be able to receive all of the cooled solids from the upper heat exchange chamber 36, and possibly, also some additional solids from the internal circulation, it is clear that the volume of the lower heat exchange chamber 38 should be at least that of the upper heat exchange chamber. As has already been discussed above in the PCT publication (WO 2007/128883 A2), neither the height nor the width of the lower heat exchanger 38 can be chosen freely, but both the pressure loss in the fluidization, and the space occupied by the heat exchanger have to be optimized. This results in that the dimensions of the lower heat exchange chamber 38 are substantially equal to the upper one 36. Thereby, there is very little room in connection with the lower section of the furnace 12 for the equipment necessary for running the boiler 10, such as, for example, the start-up burner, a measuring device for measuring the lower furnace temperature, a measuring device for measuring the bed pressure, and feeds for introducing fuel, bed material, secondary air, additives, recirculated flue gas (if applicable), etc.

Third, due to the various running alternatives, conduits and channels are necessary for each alternative. For instance, the upper heat exchange chamber 36 has one inlet from the separator 16, and several outlet channels and lift channels. One lift channel and outlet channel leading to the lower heat exchanger 38, another lift channel and outlet channel leading to the furnace 12, and an overflow channel leading to the lower heat exchange chamber 38. In addition to the channels, rather complicated fluidization means and controller for adjusting the fluidization also are required at the bottom of the upper heat exchange chamber 36. If, and when, the various channels and conduits require bellows to separate components in different temperatures, the bellows, again, occupy space, and also increase the costs of the heat exchanger arrangement together with the numerous channels, conduits, fluidization equipment, and control systems that have already been discussed above.

Figure 2:
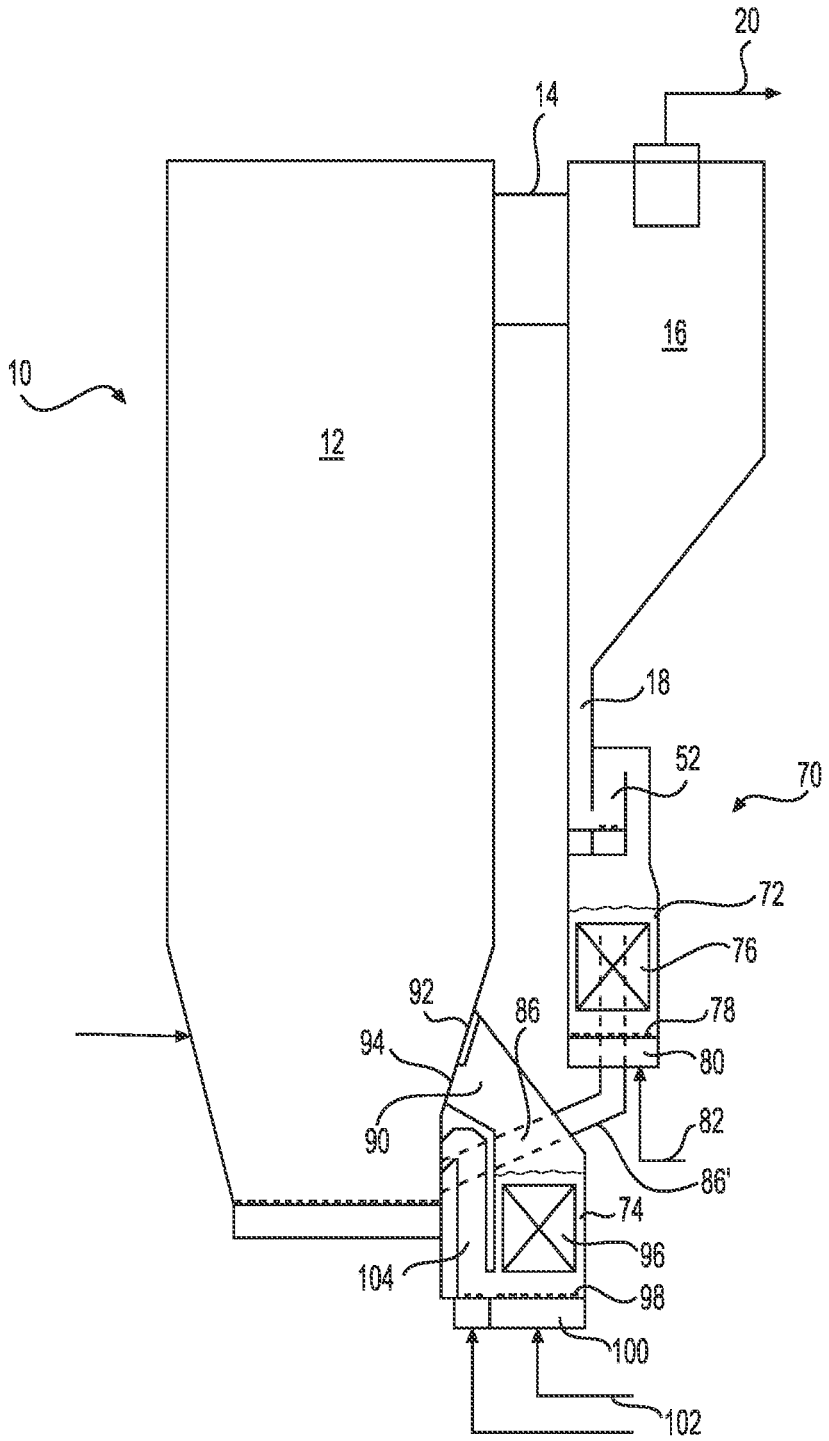
FIG. 2 is a schematic vertical cross section of a heat exchanger arrangement in accordance with a preferred embodiment of the present invention.
Figure 3:
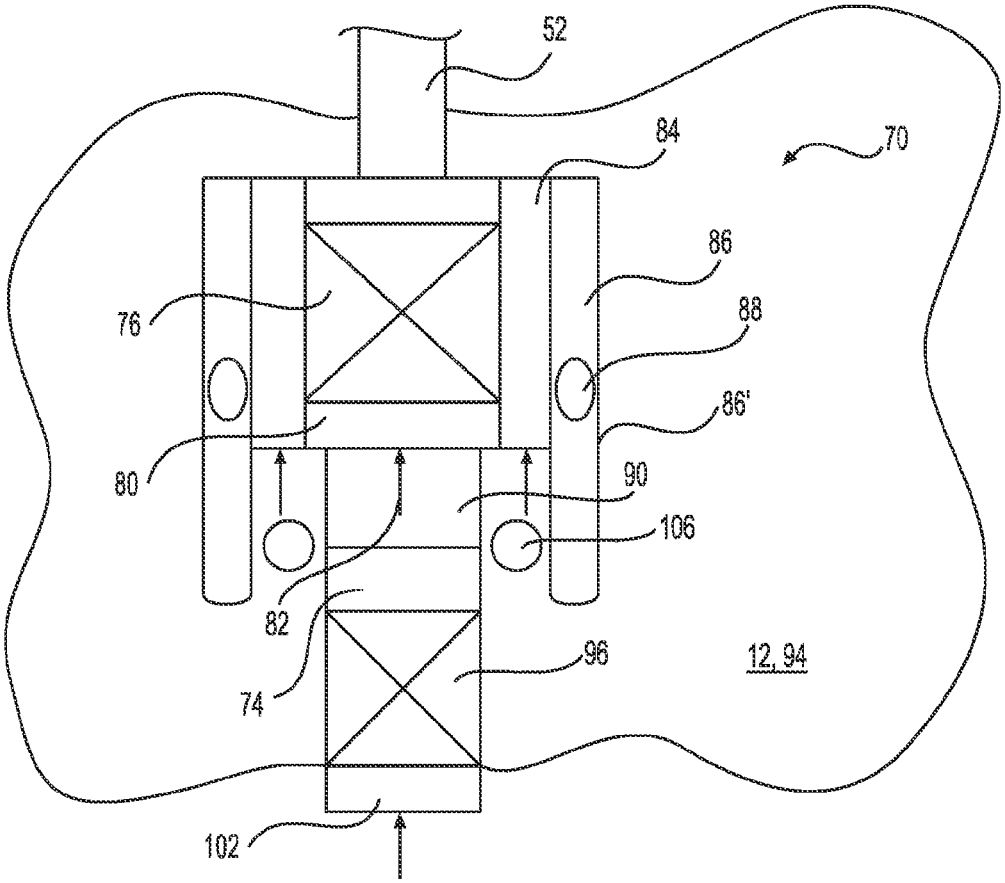
FIG. 3 is a schematic back view of a heat exchanger arrangement in accordance with the preferred embodiment of the present invention shown in FIG. 2.

A solution to at least some of the above-mentioned drawbacks and problems is illustrated in FIGS. 2 and 3, which show a novel heat exchanger 70 arrangement for a CFB boiler 10. The heat exchanger arrangement 70 comprises two heat exchanger chambers 72 and 74. The upper heat exchange chamber 72 is in flow communication with the solids separator 16 via a gas seal 52. Preferably, the upper heat exchange chamber 72 is supported from the separator 16, but since the upper heat exchange chamber 72 is very close to the furnace wall, the heat exchange chamber 72 may also be supported by the furnace wall and its reinforcement structures. The heat exchange chamber 72 is also provided with internal heat exchange surfaces 76, and nozzles 78 at the bottom of the chamber 72. Below the nozzles 78 is a wind box 80 for blowing fluidization air 82 into the fluidized bed heat exchange chamber 72 for fluidizing the solids entering the chamber from the separator 16. In this preferred embodiment of the invention, the upper fluidized bed heat exchange chamber 72 is provided with two lift channels 84 on both lateral sides of the chamber 72, and, naturally, also, two return channels 86 for taking the cooled solids back to the furnace 12. In accordance with an additional embodiment of the present invention, the return channel 86 is provided with a feed 88 for introducing fuel into the solids flow.

A lower fluidized bed heat exchange chamber 74 is arranged below the upper fluidized bed heat exchange chamber 72, and, preferably, in connection with the wall of the furnace lower section. Further, the lower heat exchange chamber 74 is situated between the return channels 86 of the upper heat exchange chamber 72, in fact, between the lower ends of the return channels 86. The lower heat exchange chamber 74 is provided with an inlet channel 90 for receiving hot solids directly from the furnace 12 via an opening 92 in the, preferably oblique, furnace wall 94. The lower heat exchange chamber 74 further has internal heat exchange surfaces 96, bottom nozzles 98, and a wind box 100 below the bottom from where fluidization air 102 is blown into the fluidized bed heat exchange chamber 74. The lower fluidized bed heat exchanger 74 further has a lift channel 104 along which solids from the chamber 74 are discharged into the lower section of the furnace 12. The lift channel 104 needs its own nozzles, wind box, and air feed to be able to lift the solids into the lift channel 104.

The advantages of the present invention may be seen in both FIGS. 2 and 3. It has been shown that the separator 16 and the upper fluidized bed heat exchange chamber 72 are located much closer to the furnace 12 than in the prior art construction of FIG. 1. The cause for this improvement is the fact shown in FIG. 3 that the lift channels 84 and return channels 86 have been arranged to the lateral sides of the fluidized bed heat exchange chamber 72, and not between the chamber and the furnace wall, as in the prior art. A further option would be to arrange the lift channel 84 and the return channel 86 such that they both have a common wall with the chamber 72 such that, in the illustration as in FIG. 3, the channels would not be side by side (as in FIG. 3), but one after the other, whereby the usage of space would be very effective, and would make it possible to bring the adjacent heat exchange chamber (and the separator) even closer to each other.

FIG. 3 clearly shows how the lower fluidized bed heat exchange chamber 74 may be built narrower than the upper heat exchange chamber 72, as the lower heat exchange chamber 74 receives high temperature solids from the furnace 12 only, and thereby the size, i.e., the width of the chamber 74, may be reduced. Thus, this construction offers room for other equipment at the sides of the lower heat exchange chamber 74. Here, such has been exemplified by openings 106 in the wall 94 of the furnace 12. The openings 106 may be provided with feeds for introducing fuel, bed material, secondary air, etc., into the furnace 12 or with a start-up burner.

As to the heat exchange surfaces of the fluidized bed heat exchange chambers 72, 74, it is normal practice that the internal surfaces 76 and 96 (FIGS. 2 and 3) are used in the steam cycle. A viable option is to use the heat exchange surfaces 76 of the upper heat exchanger 72 as the last superheater stage before the steam is introduced into the high pressure turbines. A similarly viable option is to use the heat exchange surfaces 96 of the lower heat exchanger 74 for reheating the steam entering from the high pressure turbines before being introduced into low pressure turbines. The utilization of the membrane walls or the fluidized bed heat exchange chambers is, however, not that self-evident.

One alternative to utilize the wall surfaces of the heat exchange chambers 72, 74 is to arrange such in the water circulation, i.e., for preheating the water to be fed into the steam cycle of the furnace 12. For instance, one option is to feed water via an economizer in the flue gas conduit to the walls of the lower fluidized bed heat exchange chamber 74, and then, to introduce the preheated water to the evaporator tubes in the furnace walls. A further option is to take the feed water after the lower heat exchange chamber 74 to the walls of the upper heat exchange chamber 72, and only thereafter introduce the preheated water to the evaporator panels of the furnace 12. A yet further option is to take the feed water after the lower heat exchange chamber 74 to the walls of the discharge conduit that leads from the upper heat exchange chamber 72 to the furnace 12, and, thereafter, to the walls of the upper heat exchange chamber 72. This way, the feed water path from the feed water pump to the evaporator tubes in the furnace walls is as follows: feed water pump—economizer—lower heat exchange chamber walls—return channel walls 86'—upper heat exchange chamber walls—water/steam tube panels of the furnace 12. The feed water path may also be provided with water cooled hanger tubes between the economizer and the lower heat exchange chamber 74 walls. As a further option, it is also possible that the walls of the upper heat exchange chamber 72 may be steam cooled, and, optionally, integrated with the steam cooled separator.

The invention has been described above in connection with exemplary arrangements, but the invention also comprises various combinations or modifications of the disclosed embodiments. Especially, the number of separators and heat exchangers may vary from what is disclosed in FIGS. 2 and 3. Thus, it is obvious that the exemplary embodiments disclosed herein are not intended to limit the scope of the invention, but several other embodiments are also included in the invention, the embodiments being limited only by the appended claims and the definitions therein.

The invention claimed is:

1. A circulating fluidized bed boiler comprising:

a furnace for combusting solid carbonaceous fuel in a fast fluidized bed, the furnace having (i) walls made of water/steam tube panels and used for evaporating water fed therein and (ii) an outlet channel for exhaust gas at an upper portion of the furnace;

a solids separator arranged adjacent to a sidewall of the furnace for separating solids entrained with exhaust gas discharged via the outlet channel from the upper portion of the furnace;

a gas seal for receiving at least a portion of the separated solids from the solids separator;

a first fluidized bed heat exchange chamber that is arranged downstream of the gas seal and has internal heat exchange surfaces, the first fluidized bed heat exchange chamber receiving the at least a portion of the separated solids from the solids separator via the gas seal;

at least one return channel connecting the first fluidized bed heat exchange chamber to the furnace, so that solids discharged from the first fluidized bed heat exchange chamber are only conveyed to a lower portion of the furnace via the at least one return channel;

a first lift channel having a lower end connected to a bottom portion of the first fluidized bed heat exchange chamber and an upper end connected to an upper end of a first the at least one return channel for discharging solids from the first fluidized bed heat exchange chamber to the at least one return channel;

a second fluidized bed heat exchange chamber being (i) arranged adjacent to a lower sidewall of the furnace and having internal heat exchange surfaces, (ii) positioned below the first fluidized bed heat exchange chamber, and (iii) narrower than the first fluidized bed heat exchanger;

a singular inlet channel for introducing hot solids from the furnace into the second fluidized bed heat exchange chamber, the singular inlet channel directly connecting the lower portion of the furnace to the second fluidized bed heat exchange chamber so that the second fluidized bed heat exchange chamber receives hot solids only directly from the lower portion of the furnace via the singular inlet channel; and a second lift channel having a lower end connected to a bottom portion of the second fluidized bed heat exchange chamber and an upper end connected to the furnace for discharging solids from the second fluidized bed heat exchange chamber to the lower portion of the furnace, wherein the first fluidized bed heat exchange chamber has two first lift channels and two return channels arranged at the lateral sides thereof such that the second fluidized bed heat exchange chamber is situated between the lower ends of the two return channels.

2. The circulating fluidized bed boiler according to claim 1, further comprising at least one of a fuel feed, a bed material feed, a secondary gas feed, and a start up burner positioned between the first return channel and the second fluidized bed heat exchange chamber.

3. The circulating fluidized bed boiler according to claim 1, wherein the first of the two return channels includes a receiver for receiving fuel to be introduced into the lower portion of the furnace.

4. The circulating fluidized bed boiler according to claim 1, wherein the walls of each of the first and second fluidized bed heat exchange chambers are made of water tube panels.

5. The circulating fluidized bed boiler according to claim 4, wherein the first of the two return channels has walls made of water tube panels.

6. The circulating fluidized bed boiler according to claim 4, wherein the walls of at least one of the first fluidized bed heat exchange chamber, the second fluidized bed heat exchange chamber, and the first return channel are used for heating water to be introduced into the water/steam tube panels of the furnace.

* * * * *